US005183328A

United States Patent [19]

Osteen

[11] Patent Number: 5,183,328

[45] Date of Patent: Feb. 2, 1993

[54] LUMINAIRE HAVING AN IMPROVED THERMAL MANAGEMENT ARRANGEMENT

[75] Inventor: Mitchell M. Osteen, Zirconia, N.C.

[73] Assignee: General Electric Company, Schenectady, N.Y.

[21] Appl. No.: 805,249

[22] Filed: Dec. 9, 1991

[51] Int. Cl.[5] ..... F21V 29/00

[52] U.S. Cl. ..... 362/294; 362/345; 362/373

[58] Field of Search ..... 362/293, 294, 345, 307, 362/373

[56] References Cited

U.S. PATENT DOCUMENTS

| | | | |
|---|---|---|---|
| 1,824,894 | 9/1931 | Hopkin, Jr. | 362/294 X |
| 3,310,672 | 3/1967 | Bursell | 362/345 X |
| 3,588,488 | 6/1971 | Lauterbach | 362/294 X |
| 4,985,815 | 1/1991 | Endo | 362/373 X |

*Primary Examiner*—Allen M. Ostrager
*Attorney, Agent, or Firm*—George E. Hawranko; Stanley C. Corwin

[57] ABSTRACT

In an industrial luminaire having an acrylic reflector for directing light output in a desired pattern, and in which a high wattage light source is utilized, a cooling sleeve constructed of a light transmissive material is mounted in surrounding proximity to the light source. The cooling sleeve is cylindrically shaped with at least one opening through which heat generated by the light source can be channeled away from the acrylic reflector in a chimney like manner. The cooling effect of the sleeve is further supplemented by the ability to pass a flow of air within the reflector, around the cooling sleeve, and through a space formed between the reflector and the cooling sleeve. A venting arrangement can be formed in the housing or other support structure on which the reflector, light source and cooling sleeve are mounted.

14 Claims, 2 Drawing Sheets

LUMINAIRE HAVING AN IMPROVED THERMAL MANAGEMENT ARRANGEMENT

FIELD OF THE INVENTION

This invention relates to a luminaire having an improved thermal management arrangement associated therewith. More particularly, this invention relates to such a luminaire as utilizes a cooling sleeve member in proximity to the light source so that heat generated by the light source can be channelled away from a reflector mounted on the luminaire. The cooling sleeve of the present invention is effective for maintaining the reflector at acceptable operating temperatures while at the same time, providing such thermal management capability without sacrificing a significant amount of light output from the light source.

BACKGROUND OF THE INVENTION

Luminaires of the type which typically include a prismatic reflector for the purpose of efficiently directing the light output in a desired pattern, utilize a high intensity light source which can generate a significant amount of heat and radiation. Without design consideration, the heat and radiation could damage the reflector. An example of a luminaire which utilizes a prismatic reflector constructed of an acrylic material, can be found in U.S. Pat. No. 4,903,180 issued to Taylor et al on Feb. 20, 1990 and assigned to the same assignee as the present invention, such patent being hereby incorporated by reference. Because the prismatic reflector in such a luminaire is constructed of an acrylic material, in order to prevent damage to the reflector, it is necessary to use a low wattage light source which does not produce heat and radiation at a damaging level to the prismatic reflector of a given size. Alternatively, if a higher wattage light source is preferred, one could be required to provide a prismatic reflector which is significantly increased in size to accommodate the higher heat and radiation levels associated with the higher wattage lamps. Exemplary values for the reflector size and lamp wattage size for a luminaire such as described in U.S. Pat. 4,903,180 are: a 25 inch bottom diameter, 12 inch top diameter and 14 inch height for the reflector and, for the light source, a 400 watt high intensity discharge lamp is used. With such a configuration, it has been measured that the reflector is exposed to a 55° C. temperature which is well within the limit of 85° C. for acrylic materials.

For an industrial or commercial lighting application, it would be advantageous to provide a luminaire that could deliver a higher light output than that which can be achieved using a 400 watt lamp. For instance, some lighting applications require the use of a 1000 watt high intensity light source. If such a light source were to be utilized, it is estimated that the dimensions of the reflector would have to be on the order of 50% larger than that used for the 400 watt lamp. Such an increase in reflector size is impractical given the fact that an acrylic reflector will be formed using an injection molding manufacturing process. Such a process is inherently expensive since the tooling cost of making and operating the larger sized mold would be extensive. Moreover, one cannot merely increase the size of a reflector by 50% without first considering design changes to insure the integrity of the actual reflector structure and maintain the desired light distribution properties; it is probable that the increased size would result in a weaker structured product susceptible to damage having poorer optical properties. Accordingly, it would be advantageous to provide a luminaire with a prismatic reflector that could accommodate a range of lamp wattages and yet maintain the same size and structure for the reflector which would be capable of withstanding the range of heat and radiation levels output by the various sized lamps.

SUMMARY OF THE INVENTION

A luminaire having a prismatic reflector associated therewith, includes an improved thermal management arrangement which is effective such that the luminaire can accommodate a wide range of lamp wattages without experiencing damage to the acrylic reflector as may otherwise occur as a result of the increased heat and radiation associated with a light source having a rating in the range of 1000 watts. The improved thermal management arrangement is effective for reducing the ambient temperature in the vicinity of the reflector to a level below the critical value of 85° C. and yet, does so without adversely affecting the light output characteristics of the luminaire.

In accordance with the principles of the present invention, there is provided a luminaire having an improved thermal management arrangement which allows for the use of a wide range of light source power levels and wherein the light source is a high intensity lamp. The luminaire includes a prismatic reflector made of an acrylic material; such reflector being effective for selectively directing the light output of the luminaire in a desired pattern. Disposed between the light source and the reflector is a cooling sleeve member constructed of a light transmissive material. The sleeve is disposed within the luminaire in surrounding proximity to at least a portion of the light source. Additionally, the cooling sleeve is mounted within the luminaire so that an opening formed at the upper end of the sleeve, opens into the luminaire housing thereby allowing thermal convection currents generated by the light source to be directed away from the reflector member. A venting arrangement such as louvers can be formed on the luminaire housing to allow the heat to be channeled out of the luminaire. The cooling sleeve can be constructed of a synthetic resin polymer such as Teflon® (Teflon is a registered trademark of DuPont) so that light blockage is kept at a minimum and further, so that the heat generated by the light source can be effectively channeled upward and away from the reflector member.

As a further thermal improvement, when the reflector member and cooling sleeve are mounted in the luminaire housing, a space is formed between the upper opening of the reflector member and the opening of the sleeve member. This space allows air flow to occur within the reflector and around the sleeve member, such air flow having the advantage of providing a cooling effect to the sleeve and reflector and further being effective for preventing the buildup of dirt on the inside surface of the reflector. The air flow can pass through the space and then be channeled out of the luminaire through the same venting arrangement used to remove heat funneled from the lamp and space inside the cooling sleeve.

BRIEF DESCRIPTION OF THE DRAWINGS

In the following detailed description, reference will be made to the attached drawings in which.

DETAILED DESCRIPTION OF THE INVENTION

Figure 1:
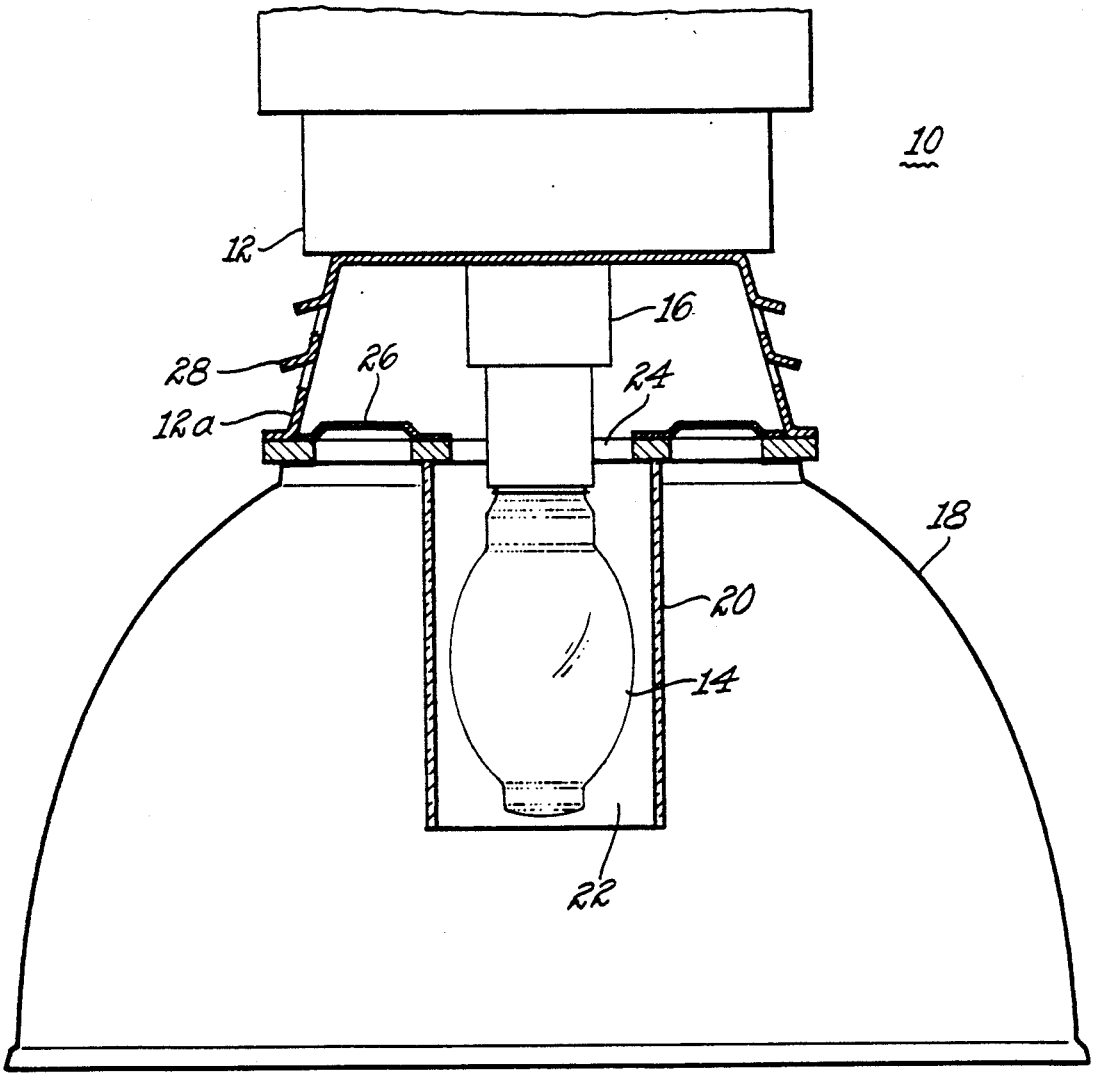
FIG. 1 is an elevational view of a luminaire constructed in accordance with the present invention.

As seen in FIG. 1, an industrial or commercial luminaire 10 includes a housing 12 in which is disposed a lamp ballast (not shown) used to efficiently energize the light source 14. The light source 14 can be a high intensity discharge lamp with a power rating of up to 1000 watts. The light source is connected to the lamp ballast by means of a conventional lamp socket 16. A dome-shaped reflector member 18 is attached to the housing 12 and extends over and beyond the light source 14. The reflector 18 is constructed of an acrylic material and is typically manufactured using conventional injection molding manufacturing techniques. Regarding the construction of the reflector 18, representative dimensions have been previously disclosed as being a 25 inch bottom diameter, a 12 inch upper diameter and a 14 inch height. When a reflector 18 of these dimensions has been utilized in conjunction with a 400 watt high intensity discharge lamp, measured results have shown a 55° C. ambient temperature, the operating temperature at the reflector walls are therefore, well below the critical temperature of 85° C. for acrylic. Of course, it can be appreciated that other reflector dimensions will be equally effective for a more efficient thermal operation using higher wattage lamps provided the features of the present invention are also utilized, which features will be described later in further detail.

In utilizing an acrylic material for the dome shaped reflector 18, the luminaire 10 provides the ability to direct light output not only in the downward direction, but also in an uplighting manner by means of refractive prisms (not shown) on the reflector 18. For a more detailed description of the optical characteristics of an acrylic reflector containing a plurality of reflective and refractive prisms, reference is hereby directed to the previously discussed U.S. Pat. No. 4,903,180.

In order to operate the luminaire 10 using a 1000 watt light source as opposed to the 400 watt version typically utilized for the acrylic reflector 18, it is necessary that an improved thermal management scheme be utilized so that damage to the reflector member 18 as would be caused by the increased heat generated by the higher wattage light source 14, is prevented. Presuming that a commensurate increase in the dimensions of the reflector 18 is not an economically feasible alternative, adding components is the appropriate action. One must consider however that any components added to the luminaire 10 must not only satisfy the thermal management requirements but as well, must avoid the detrimental effect of blocking the light output of the luminaire 10. To this end, a cooling sleeve member 20 constructed of a light transmissive material, is disposed in a surrounding relation to the light source 14. The cooling sleeve member 20 is essentially cylindrically shaped although other shapes are also possible as well, provided the surrounding relation to the light source 14 is maintained, and includes a first opening 22 at the bottom end as shown in FIG. 1, and a second opening 24 at the top end of the cooling sleeve 20. In mounting the cooling sleeve 20 to the luminaire 10, a lower housing support segment 12*a* can serve both to attach the upper rim of the reflector member 18 and, by the use of finger like projections 26 disposed strategically at certain positions along the circumference of the cooling sleeve 20, can also serve as the point of mounting for the cooling sleeve 20 without blocking any significant space between the respective upper openings of the reflector member 18 and the cooling sleeve 20.

In the construction of the cooling sleeve 20, it is desired to achieve a device which is structurally secure, exhibits good thermal performance characteristics and also has light transmissive properties which allow for the maximum amount of light output from the light source 14 to be directed to the reflector member 18. It has been found that the material TFE Teflon (poly-tetra-fluoro-ethelene) formed to a thickness of between 0.01 and 0.025 inches provides the necessary thermal and optic performance characteristics that allows for the use of a 1000 watt light source 14 in a luminaire 10 having a reflector member 18 constructed for use with a 400 watt light source. It has been measured that for a 1000 watt light source 14 using the cooling sleeve 20 of the present invention, the temperature at which the reflector member 18 is exposed is in fact lower than that experienced using a 400 watt light source and no cooling sleeve. This improvement is at least partially the result of the use of the Teflon material for which it is known that, with the temperature of the lamp jacket typically in the range of 400° C., the radiation generated is in the several micron wavelength range, a range which Teflon typically absorbs. With respect to the dimensions of the cooling sleeve 20, as seen in FIG. 1, the sleeve extends essentially to the end of the light source 14, which for the type of lamp utilized, would result in a length of approximately 8–9 inches. As to the radius of the cooling sleeve 20, it can be seen that the sleeve 20 is disposed in closely spaced proximity to the widest diameter portion of the light source 14, which is the area in which the discharge will occur. Though not shown to scale in FIG. 1, the cooling sleeve 20 used with a 1000 watt light source 14 will have a diameter of approximately 8–9 inches when the diameter of the light source wall is 6–7 inches. If a smaller diameter light source is used, the cooling sleeve diameter will be decreased proportionally. It can be appreciated that these dimensions are exemplary only and are not intended to limit the scope of the present invention. Additionally, although cooling sleeve 20 is shown extending to the end of the light source 14, a shorter version cooling sleeve could be utilized as well provided that the portion of the light source in which the discharge occurs were covered by the cooling sleeve 20.

In the operation of the cooling sleeve 20 in conjunction with the 1000 watt light source 14, a significant portion of the heat generated by the light source 14 can be effectively channeled upward through the cooling sleeve 20 and into the environs of the housing support segment 12*a*. Formed around the periphery of the housing support segment 12*a* is a series of louvers 28 which allow the heat channeled by the sleeve member 20 through the second opening 24 to escape externally of the luminaire 10. Of further significance to the improved thermal management properties of the luminaire 10 utilizing the cooling sleeve 20 of the present invention is that an air flow as can occur within the envelope defined by the inner portion of reflector member 18, further adds to the cooling effect of the sleeve 20. That is, air flow that occurs within the reflector member 18 will pass along the surface of the sleeve member 20, through the space that exists between the respective upper ends of the reflector member 18 and the cooling sleeve 20 thereby serving to further reduce the effect to the reflector 18 of the heat generated by the light source 14.

In addition to supplementing the cooling capabilities of the cooling sleeve 20, a further effect of the air flow within the reflector member 18 is to minimize the amount of dirt or grime that might otherwise accumulate on the inside surface of the reflector member 18. By providing a path through which air flow can travel through the reflector member 18 and then through the space between the cooling sleeve 20 and reflector top portion, such air flow can be channeled through the louvers 28 and thereby serve the dual purpose of supplementing the cooling effect of the cooling sleeve 20 and also, of preventing the accumulation of dirt and grime on the inside surface of the reflector member 18, a condition which would otherwise detrimentally affect the light output of the luminaire 10.

As seen in FIG. 1, the respective top portions of the reflector member 18 and cooling sleeve 20 are essentially even so as to allow for the previously discussed space. It would be possible however to dispose the top portion of the cooling sleeve 20 at a level below the top portion of the reflector and still achieve the necessary cooling effect. Because of the chimney effect caused by the cooling sleeve 20, the hot air channeled away from the reflector member 18 is effectively expelled from the top opening 24 of the cooling sleeve 20 into the housing extension segment 12*a* and, by such expelling action, the hot air cannot affect the reflector member 18 if the cooling sleeve 20 were disposed slightly below the top portion of the reflector member 18.

Figure 2:
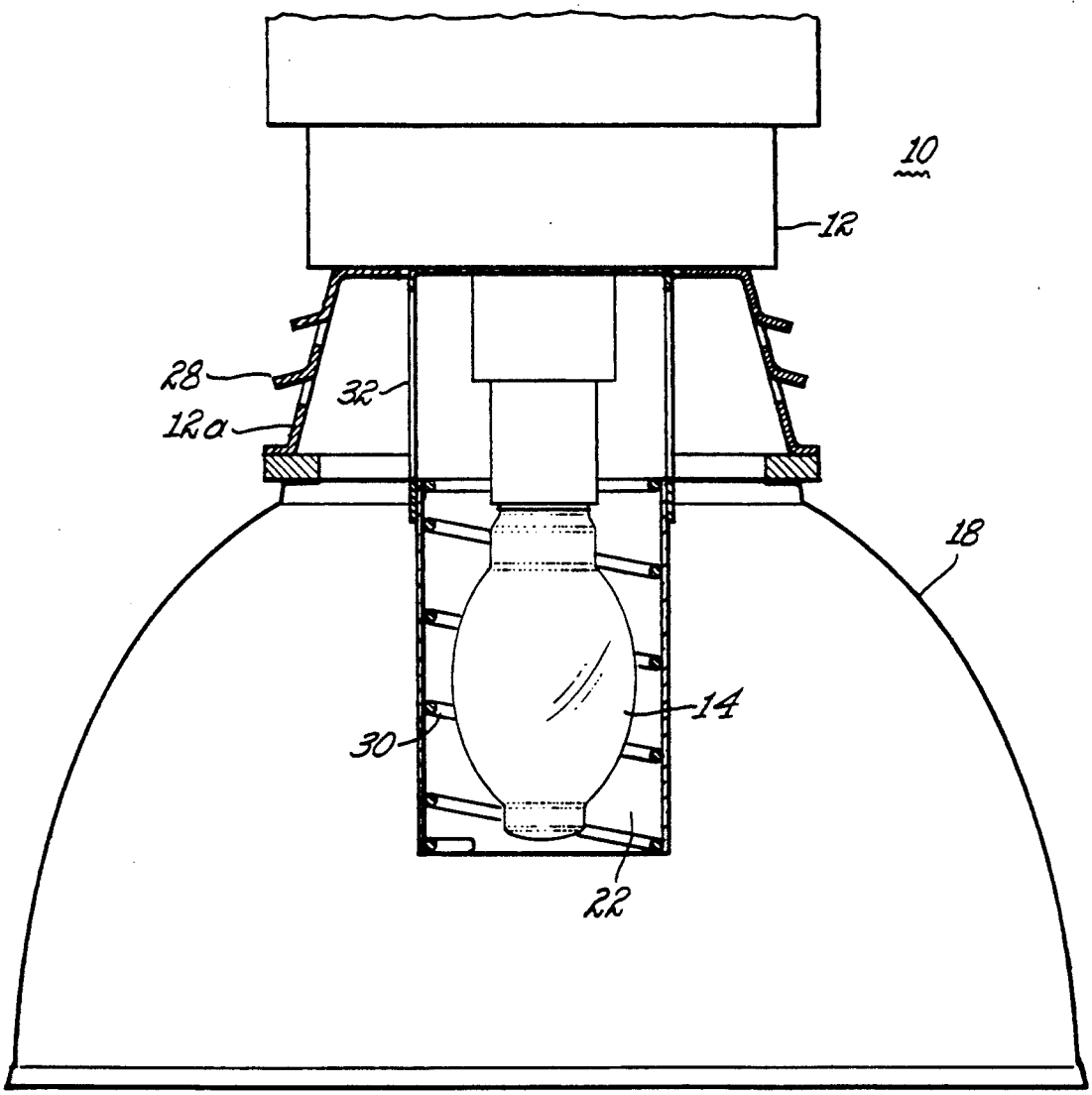
FIG. 2 is an elevational view of a luminaire constructed in accordance with another embodiment of the present invention.

As seen in FIG. 2, an alternate arrangement for achieving the thermal management properties needed to operate a luminaire 10 having an acrylic reflector member 18 constructed for use with a 400 watt light source, at the higher power level of a 1000 watt light source, utilizes a lesser thickness Teflon material for the cooling sleeve 20. In this embodiment, the TFE Teflon having a thickness of between 0.01 and 0.025 inches, has been replaced by FPE Teflon (fluoronated ethelene propylene) having a thickness of approximately 0.005 inches. In order to utilize this lesser thickness Teflon however, it is necessary to include a wire support member 30 within the cooling sleeve 20 so as to prevent the collapse of the cooling sleeve. As further seen in FIG. 2, an alternate arrangement for supporting the cooling sleeve 20 within the housing extension segment 12*a* is proposed. Instead of the finger-like projections 26 of FIG. 1, the cooling sleeve 20 of FIG. 2 is supported by a U-shaped bracket 32 which attaches to the housing 12 at the top end and at two diametrically opposed points along the circumference of the cooling sleeve 20.

In terms of the quality of performance between the two embodiments shown in FIGS. 1 and 2 respectively, it has been measured that the wire support member 30 accounts for an additional 2–3% light blockage but that, because of the lesser thickness of the FEP Teflon cooling sleeve 20, such light blockage is offset by the increased transmissivity of the lesser thickness cooling sleeve. Accordingly, in terms of performance, the embodiments of FIGS. 1 and 2 exhibit essentially the same optical and thermal characteristics.

Although the hereinabove described embodiments of the invention constitute preferred embodiments, it should be understood that modifications can be made thereto without departing from the scope of the invention as set forth in the appended claims. For example, while we have used illustrative examples of the plastic prismatic reflector made of acrylic material and the cooling sleeve made of Teflon materials, it can be appreciated that other suitable plastic materials selected to serve equivalent functions, are within the scope of this patent.

I claim:

1. A lighting fixture comprising:

a fixture support member;

a high intensity light source connected to said support member;

means for energizing said light source, said energizing means being connected to said support member;

reflector member connected to said support member and being disposed at least partially around said light source so as to direct the light output of said light source in a predetermined pattern, said reflector member having at least one opening formed therein;

a sleeve member connected to said support member and being disposed in at least a partially surrounding manner to said light source and at a position between said reflector member and said light source;

wherein said sleeve member is constructed of a light transmissive material and has an opening formed at the upper end thereof, said sleeve member being effective such that a portion of the heat generated by said light source can be channeled through said sleeve member opening and away from said reflector member thereby; and, wherein said opening of said sleeve member is smaller in size relative to said at least one reflector opening, said sleeve member opening and said reflector member opening being disposed relative to one another such that a space exists therebetween, said space being effective such that an air flow can occur between said reflector member and said sleeve member, such air flow travelling through said space.

2. A lighting fixture as set forth in claim 1 wherein said reflector member is shaped in a flared manner and wherein said at least one opening is a first and a second opening formed at opposite ends of said reflector member, said second opening being larger than said first opening and wherein said first opening is formed at one end of said reflector member on which said reflector member is connected to said support member.

3. A lighting fixture as set forth in claim 1 wherein said sleeve member is cylindrically shaped and said light transmissive material from which said sleeve member is constructed is Teflon.

4. A lighting fixture as set forth in claim 3 wherein said sleeve member constructed of said Teflon material has a thickness of at least 0.01 inches.

5. A lighting fixture as set forth in claim 3 wherein said sleeve member constructed of said Teflon material has a thickness of less than 0.01 inches and further wherein said sleeve member includes an inner support member.

6. A lighting fixture as set forth in claim 3 wherein said reflector member is constructed of an acrylic material.

7. A luminaire comprising;

a housing;

a dome-shaped reflector mounted on said housing;

a light source mounted on said housing so as to be disposed substantially at a central longitudinal axis to said reflector;

means for energizing said light source, said energizing means being disposed in said housing;

a sleeve member constructed of light transmissive material and being mounted on one end to said housing, said sleeve member being disposed in surrounding proximity to at least a portion of said light source, said sleeve member further being mounted to said housing member in a manner so that an opening formed at one end thereof opens into said housing and is effective such that heat generated by said light source can be directed through said opening and away from said reflector member; and, means for venting such heat externally of said housing.

8. A luminaire as set forth in claim 7 wherein said light source is a high intensity discharge lamp and said sleeve member extends around at least the portion of said discharge lamp in which a discharge occurs.

9. A luminaire as set forth in claim 7 wherein said sleeve member is cylindrically shaped and said light transmissive material is TFE Teflon having a thickness of at least 0.01 inches.

10. A luminaire as set forth in claim 7 wherein said sleeve member is cylindrically shaped and said light transmissive material is FEP Teflon having a thickness of less than 0.01 inches.

11. A luminaire as set forth in claim 10 further comprising a wire support member disposed within said sleeve member, said wire support member being effective such that the collapse of said less than 0.01 inch thickness sleeve member is prevented thereby.

12. A luminaire as set forth in claim 7 wherein said venting means includes louvers formed in said housing in the vicinity of said opening formed at said one end of said sleeve member.

13. A luminaire as set forth in claim 7 further comprising a space formed between said end of said sleeve member on which said opening is located and a corresponding end of said dome-shaped reflector member, said space being effective such that air flow occurring within said reflector member and around to said sleeve member can be directed through said venting means.

14. A luminaire as set forth in claim 13 wherein said sleeve member is cylindrically shaped having a second end opposite to said end on which said opening is formed, and further wherein said reflector member has a wide opening formed at the end corresponding to said second end of said sleeve member, said wide opening of said reflector member being substantially larger than said corresponding end of said reflector member at which said space is formed so that such air flow occurring within said reflector member is directed through said space in a funnel-like manner.

* * * * *